US009637293B2

(12) United States Patent
Krumme et al.

(10) Patent No.: US 9,637,293 B2
(45) **Date of Patent: *May 2, 2017**

(54) CHILDPROOF HIGHLY-INERT PACKAGING FOR INDIVIDUALLY DOSED FILMS CONTAINING AN ACTIVE INGREDIENT

(71) Applicant: LTS LOHMANN THERAPIE-SYSTEME AG, Andernach (DE)

(72) Inventors: Markus Krumme, Allschwil (CH); Grace A. Behrend, Englishtown, NJ (US); Stephen J. Dodd, Great Bookham (GB)

(73) Assignee: LTS LOHMANN THERAPIE-SYSTEME AG, Andernach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/146,161

(22) Filed: May 4, 2016

(65) Prior Publication Data

US 2016/0297592 A1 Oct. 13, 2016

Related U.S. Application Data

(60) Division of application No. 13/923,660, filed on Jun. 21, 2013, now Pat. No. 9,370,463, which is a (Continued)

(51) Int. Cl.

| | |
|---|---|
| ***B65D 75/00*** | (2006.01) |
| ***B65D 75/58*** | (2006.01) |
| ***A61J 1/00*** | (2006.01) |

(52) U.S. Cl.
CPC ..... *B65D 75/5833* (2013.01); *A61J 1/00* (2013.01); *B65D 2221/00* (2013.01)

(58) Field of Classification Search
CPC ..... B65D 2221/00; B65D 75/5833; B65D 75/5811; B65D 75/5805; B65D 75/58;
(Continued)

(56) References Cited

U.S. PATENT DOCUMENTS 2,499,528 A * 3/1950 Reitzes ..... B65D 75/5816 383/106
2,684,807 A * 7/1954 Gerrish ..... B65D 75/66 383/206

(Continued)

FOREIGN PATENT DOCUMENTS

WO WO 2007/143411 A1 12/2007

*Primary Examiner* — Peter Helvey
(74) *Attorney, Agent, or Firm* — R. S. Lombard

(57) ABSTRACT

A childproof packaging for individual doses, in particular for preparations for administration in film form, wherein the packaging constitutes a bag produced by sealing, which has a covering layer which is provided at each side of the packaging with local weak points which do not touch the edge of the packaging, wherein the local weak points form a cohesive pattern which runs around the individual dose in an arc or a curve and overlaps an angular region of at least 90° when considered from the main area of the individual zone. The local weak points have a start area and an end area which have a Y configuration when the local weak points on each side of the packaging are superposed.

2 Claims, 4 Drawing Sheets

Related U.S. Application Data continuation-in-part of application No. PCT/EP2011/006460, filed on Dec. 21, 2011.

(60) Provisional application No. 61/460,023, filed on Dec. 23, 2010.

(58) Field of Classification Search
CPC .... B65D 75/12; B65D 75/5816; B65D 75/20; B65D 75/30; B65D 85/16; B65D 31/10; A61J 1/00
USPC ..... 383/207–209; 206/530, 532, 538, 539
See application file for complete search history.

(56) References Cited

U.S. PATENT DOCUMENTS 2,967,010 A * 1/1961 Cuffey, Jr. ..... B65D 5/54 206/449
3,388,836 A * 6/1968 Otto ..... B65D 75/5805 222/107
3,397,835 A * 8/1968 Henning ..... B65D 75/5816 383/200
3,480,198 A * 11/1969 Repko ..... B65D 75/5805 383/203
3,535,409 A * 10/1970 Rohde ..... B29C 37/0057 264/171.28
3,741,778 A * 6/1973 Rowe ..... B65D 81/3492 383/122
3,809,220 A * 5/1974 Arcudi ..... B65D 75/5888 206/484
4,498,591 A * 2/1985 Smith, II ..... B31B 1/88 383/209
4,982,845 A * 1/1991 Prascak ..... B65D 75/5827 206/812
5,169,696 A * 12/1992 Lang ..... B32B 27/32 222/107
5,198,276 A * 3/1993 Nakajima ..... B65D 75/5805 428/136
5,222,813 A * 6/1993 Kopp ..... B65D 75/5805 229/87.05
5,248,040 A * 9/1993 DeMatteis ..... B65D 33/001 206/554
5,470,419 A * 11/1995 Sasaki ..... B29C 47/0021 156/244.12
5,511,664 A * 4/1996 Aramaki ..... B65D 75/5833 206/387.1
5,552,202 A * 9/1996 May ..... B65D 33/2533 383/204
5,558,438 A * 9/1996 Warr ..... B65D 75/5816 383/10
5,593,229 A * 1/1997 Warr ..... B65D 33/08 383/10
5,878,888 A 3/1999 Faughey
5,899,333 A * 5/1999 Williams ..... B65D 75/32 206/469
5,934,809 A * 8/1999 Marbler ..... B65D 75/5833 229/87.05
6,230,894 B1 5/2001 Danville
6,340,088 B1 * 1/2002 Mouri ..... B65D 75/566 206/720
6,342,258 B1 * 1/2002 Berings ..... B65D 81/3415 206/5
6,352,365 B1 * 3/2002 Healy ..... B65D 33/01 383/100
6,360,916 B1 * 3/2002 Sokolsky ..... B65D 75/5822 222/107
6,402,379 B1 * 6/2002 Albright ..... B65D 75/5816 383/209
6,679,629 B1 * 1/2004 Benito-Navazo ..... B65D 33/14 206/466
6,702,462 B2 * 3/2004 Richardson ..... B65D 75/566 222/107
7,757,855 B2 * 7/2010 Jarvis ..... B65D 65/40 206/524.1
7,967,510 B2 * 6/2011 Martuch ..... B65D 75/5833 229/87.05
8,251,217 B2 * 8/2012 Hemmerlin ..... B65D 75/5805 206/532
2001/0009231 A1 7/2001 Danville
2005/0150891 A1 * 7/2005 Schalk ..... B65D 17/161 220/266
2008/0037912 A1 2/2008 Martuch
2008/0037913 A1 2/2008 Martuch

* cited by examiner

CHILDPROOF HIGHLY-INERT PACKAGING FOR INDIVIDUALLY DOSED FILMS CONTAINING AN ACTIVE INGREDIENT

CROSS-REFERENCE TO RELATED APPLICATIONS

This is a divisional and claims the benefit of U.S. patent application Ser. No. 13/923,660 filed Jun. 21, 2013. The said U.S. patent application Ser. No. 13/923,660 is a continuation-in-part application of pending international application PCT/EP2011/006460 filed Dec. 21, 2011 and claiming the priority benefit of U.S. Provisional Application No. 61/460,023 filed Dec. 23, 2010. The said U.S. patent application Ser. No. 13/923,660, the said pending international application PCT/EP2011/006460, and the said U.S. Provisional Application No. 61/460,023 are incorporated herein by reference in their entirety.

BACKGROUND OF THE INVENTION

The invention relates to a childproof and highly inert pouch for single-dose films containing active substance.

For general use, it is often necessary for medicines to be packaged individually as single doses. The reason for this is in particular that an individual package of this kind ensures that one defined dose is taken at the desired time and accidental administration of more than one dose is avoided.

This also protects the medicine from environmental influences. In containers that hold multiple doses, the lifetime of the contents as a whole is often adversely affected by the repeated opening that is needed to remove single doses. This adverse effect is all the more marked the greater the mechanical and chemical sensitivity of the medicine.

Furthermore, a requirement that often has to be met in order to ensure safety of medicines is the protection of untargeted population groups, particularly children, against accidental medication. A further factor in this connection is the natural curiosity shown by children, since these packages are often seen as asking to be opened and, consequently, the incitement to open the packages could end up in dangerous substances being exposed by children.

On the other hand, it is important that the package can be easily opened by the intended target group, in most cases older people. This problem is neatly described by the expression "child resistant, senior friendly".

Film-shaped medicines represent a particular challenge, since the films are sensitive with respect to chemical loads (moisture, oxygen) and mechanical loads. Since film-shaped medicines generally have a large surface area, in order to be suitable for a pharmaceutical application, typically an oral application, and since a package must at all times enclose all the surfaces of the product it contains, it is necessary for a package for film-shaped medicaments to be relatively large.

In order to achieve the required protective effects, it is often necessary to use what are called high-barrier films, such as those commercially available in the form of the Sudafed PE film from Pfizer, for example. These have the disadvantage of being expensive, particularly since at least twice as much packaging material as packaged product has to be used for one package in order to fully enclose one item. It is therefore almost impossible to avoid an unfavourable ratio of packaging costs to product costs, and this has a negative impact on the price of the end product.

Childproof film packages for pharmaceutical, orally administered films are already known which afford the required chemical protection and are based on the use of a peelable pouch that is produced by heat sealing and is composed of two films, which each contain a thin aluminium layer. Such film packages sometimes contain a laterally applied cut which, however, does not cut through the pouch face itself. As a result, the package has to be folded through 90° at the middle of the cut in order to form a tearing nick in the side of the package. In this way, a tear can be made into the package in order to expose an opening aid for gripping, which then allows the two film parts to be pulled apart from each other.

This packaging principle has the disadvantage of being very expensive, since the time needed for producing such a package is quite long, and a relatively high outlay in terms of material is needed.

In addition, there are further technical solutions based on peelable films, paired and unpaired, which describe the optimization of the material outlay by optimal utilization of the film surface in the area of gripping tabs, as is described in WO 2010/025899 A1, for example.

All of the described solutions have in common that they are based on peelable films, i.e. the part of the film structure touching the product has to be peelable. Generally, these are always polyethylene-based peeling layers or similar compositions that have a relatively weak sealing seam strength, in order to be peelable.

These films have the disadvantage that they are often not inert with respect to migration of active substance, with the result that, over the course of the storage period, the active substances migrate into the package and are thus extracted from the medicine. In addition, the sealing seam strength is usually reduced by the fact that the sealed polymers are weakened by incorporation of other components that are not weldable. A side effect of such auxiliaries is reduced sealing-seam impermeability for gases such as water vapour and oxygen, which effect, over the course of the storage period and on account of the reduced storage stability of the package, can lead to problems due to water absorption of hygroscopic products, as well as to increased degradation of oxygen-sensitive products.

WO 2010/091813 A1 describes a pouch which is provided for film-shaped medicines and which, by means of a line of weakness, ensures tearability of the pouch. The combination of folds and tears on the line of weakness permits opening from one side of the package per line of weakness and thus permits access to the product from this side of the pouch.

In order to expose two or three sides of the product, two or three movement combinations of folding and tearing thus have to be performed along the lines of weakness. This can be seen as a nuisance, especially if there is a pressing need for medication, for example in cases of pain, in cases of craving, or in special emergency situations, or, if the required medication is not taken, can damage health or in the worst case lead to death.

The object of the present invention is to overcome the abovementioned disadvantages and to make available a childproof single-dose package which is based on sealed films and which permits single-motion opening in order to expose three sides of the product in one movement.

Preferred embodiments have the additional advantage that they require a minimal film consumption per dose, are inert with respect to migration of active substance and have sealing seams that do not need to satisfy any maximum sealing seam strength.

SUMMARY OF THE INVENTION

The object is achieved by a package according to Claim 1, in which a single dose is accommodated in a pouch which is produced by sealing and which at least on each side has an outer cover layer, in particular with a minimum tear resistance of 30 N (newtons) and equipped on at least one face, preferably on both faces, with local weaknesses that do not touch the edge of the package. The local weaknesses form a continuous pattern that extends in an arc or in a curved path around the single dose, which lies in the centre of the bend or curved path. Viewed from the centre of gravity of the single dose, the local weaknesses cover an angle range of at least 90°, preferably at least 120°, particularly preferably at least 180°, wherein the local weaknesses are preferably designed as lines of weakness.

The local weaknesses extend for a large part, at least however completely outside the start and end areas, in an unsealed area that also includes the single dose. At the edge, the package is preferably completely surrounded by a continuous sealing seam.

The arc described by the local weaknesses can have different bending radii, but preferably has no corners or bending radii of less than 1 mm, particularly preferably no bending radii of less than 1 cm.

In this way, opening the package is advantageously influenced by tearing it open at the local weaknesses in a single movement.

In a preferred embodiment, the local weaknesses are designed in such a way that they extend in their entirety, or at least apart from their start and end areas, no further than 5 cm, preferably at most 2 cm, particularly preferably at most 1 cm, away from the outer contour of the single dose.

In another preferred embodiment, the local weaknesses extend at least partly in such a way that, after the package has been torn open along the weaknesses, a part of the single dose is exposed.

In a preferred embodiment, both sides of the outer layer contain local weaknesses, in which case the areas of weakness on the two sides are preferably congruent.

The line of weakness preferably has a shape that twice permits a tear diversion by an angle of at least 45 degrees, particularly preferably at least 75 degrees, and in so doing allows the product in the pouch to be exposed on three sides.

In a preferred embodiment, the weakness is not formed by a cut extending through the whole cover layer or both cover layers, but by a selective weakening of the cover layer.

In a preferred embodiment, the tear initiation is permitted only after the pouch has been folded over at a defined line.

The outer cover layer is preferably imprintable. In particular, it has marks that point clearly to the tear-open mechanism in order to avoid, in an emergency situation, delays that could be caused by studying the opening mechanism. The cover layer preferably has arrows marking the local weaknesses and pointing to the tearing-open direction.

In a preferred embodiment, a metal layer, in particular a highly impermeable metal layer, preferably aluminium, is located between the outer cover layer and the single dose, on at least one side of the pouch, but preferably on both sides, which metal layer completely covers the single dose and protrudes into the surfaces of the seal.

Such an embodiment has the advantage that the pouch surfaces are inert with respect to migration of active substance, to gas exchange and to water vapour.

In another preferred embodiment, an inner sealing layer, in particular an inner sealing layer touching the product, is located between the outer cover layer and the single dose or between the metal layer and the single dose, on at least one side of the pouch, but preferably on both sides, which inner sealing layer is able to form solid and gas-impermeable sealing seams, which the outer cover layer completely covers.

The outer cover layer, the sealing layer and, if appropriate, the metal layer are preferably fixedly connected to one another, particularly in the form of a laminate.

In a preferred embodiment, the sealing layer is present only in the area of the sealing seams, such that the cover layer, or if appropriate the metal layer, comes directly into contact with the single dose. This embodiment has the further advantage of having sealing seams that are inert with respect to migration of active substance.

In a preferred embodiment, a tear can be initiated by a second weakness in the form of a cut which is inside the pouch and which can likewise be brought to the circumference of the pouch by folding along a fold line transverse to the cut. Particularly preferably, this second weakness has the form of a sidecut. Of course, this sidecut does not reach as far as the edge of the package.

In the case of the second weakness, laser treatment or other suitable ablation methods are preferably carried out to weaken the two cover layers in a manner that ensures that the tear initiated by the incision can be forced along the intended path.

Tear catchers, in particular Y-shaped pieces, for catching the tear are preferably present at this second weakness. The start and/or end areas of the local weaknesses are preferably formed such that they serve as tear catchers.

A weakness in the form of a Y geometry about the second weakness is preferably achieved by laser treatment. This Y-piece of the line of weakness permits catching of the tear after the initial tear in the second weakness and permits targeted guiding along a defined tear path. It performs the function of a tear catcher.

Another preferred embodiment has one branch of the Y on one side of the cover layer (e.g. the top) and the other branch on the opposite side (e.g. the underside), in which case the superpositioning of the two sides, i.e. the top and the underside, completes the Y. This variant permits a particularly short cycle time during production.

In a preferred embodiment, the package is symmetrical and, in particular, the local weaknesses are symmetrical. In this way, the pouch can be easily opened by right-handed and left-handed persons and provides a second opening possibility should the first attempt to open the package fail.

Another preferred embodiment contains a mechanism, in particular in the form of further lines of weakness, which mechanism, in the event of failure, offers a second chance to open the package.

An advantageous feature lies in the particular design of the weakness, produced in particular by laser ablation, on a curved path which makes it possible, by suitable combination of radius of curvature and material of the cover layer, to guide the tear profile, after initiation, such that several sides of the product are exposed in a single movement. For this purpose, a particularly preferred embodiment, as shown in the drawings, is characterized in that the line of weakness in the form of a U exposes three sides of the product, since the tear initiation is effected by the sidecut and the subsequent catching and guiding of the tear along the intended curved path is effected by the Y pieces of the line of weakness.

It is particularly preferable that the line of weakness is applied congruently on both sides of the pouch, in which case the upper web and lower web of the pouch are made of the same material. However, the invention also covers the possibility that the line of weakness is applied only on one side. In this case, the function can be made easier by suitable choice of material, e.g. by the fact that the unweakened side is made of a material that is less tear-resistant than the locally weakened top side.

A preferred method for weakening the cover layer is laser ablation. By using focused laser light of sufficient power, the outer plastic layer can be burnt away locally with great precision, without damaging any metal layer that may be present. The barrier effect of a metal film is preserved in this way.

BRIEF DESCRIPTION OF THE DRAWINGS

Examples of the package according to the invention are shown in the figures and are explained below.

DETAILED DESCRIPTION OF THE INVENTION

Figure 1:
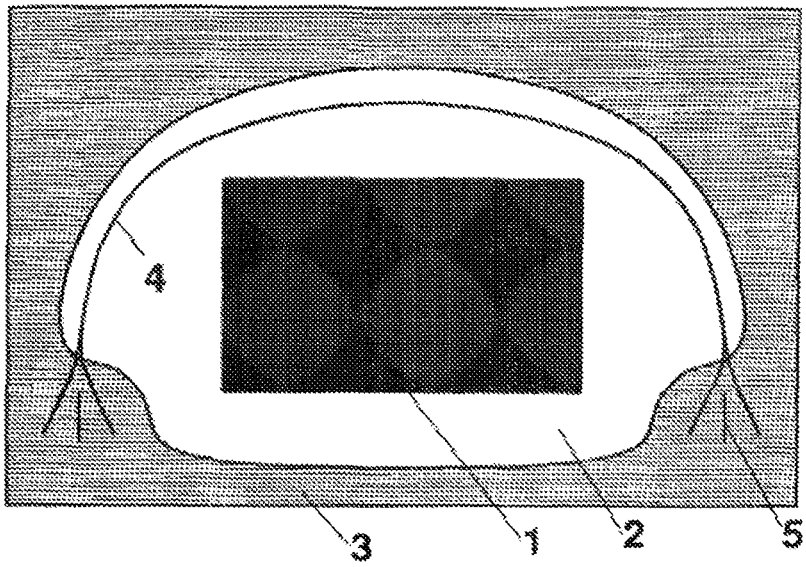
FIG. 1 shows a schematic view of a preferred package.

An example of a package according to the invention for a single dose (1) is shown in FIG. 1. It is preferably produced from high-barrier films by heat sealing. These high-barrier films are constructed in particular on the basis of aluminium films with thicknesses of preferably 9 to 20 micrometres, which ensure substantial impermeability and inertia.

In order to produce such a pouch, the two aluminium films are adhesively bonded or welded to each other in the area of the sealing seams (3), this being achieved by a laminated heat-sealable plastic layer as sealing layer, which are composed of standard materials known to a person skilled in the art, preferably from the group comprising PVC (polyvinyl chloride), PVDC (polyvinylidene chloride), PP (monaxially oriented polypropylene), Barex (British Petroleum), PE (polyethylene), Aclar (Honeywell), Topas-COC (Topas Advanced Polymers) and Surlyn and preferably have a thickness of 20 to 100 micrometres. This sealing layer is usually laminated together with the aluminium layer and thus, as a result of the structure of the pouch, automatically becomes the layer that touches the product. The more inert the material, the more advantageous it is for the product stability.

The outside of the packaging film is formed by the outer cover layer, which has a sufficiently high tear resistance to ensure that, at places where there are no local areas of weaknesses, manual tearing-open is not possible without aids. A preferred material for this is PET (polyethylene terephthalate) with a thickness of 10 to 100 micrometres, preferably of 10 to 50 micrometres.

A particularly preferred packaging material has the following structure (from the inside outwards): Barex with a thickness of 20 to 40 micrometres as the sealing layer on the side facing the single dose, aluminium with a thickness of 9 to 25 micrometres as the metal layer, and finally, as the outer cover layer, PET with a thickness of 10 to 100 micrometres, preferably of 10 to 50 micrometres. The outer cover layer can optionally be imprinted in order to identify the product. In the inside of the package, the single dose (1) is located in an unsealed area (2). In the place where this unsealed area is situated, the cover layer has, or both cover layers have, lines of weakness (4) which partially surround the single dose (1) in an arc shape.

Figure 2A:
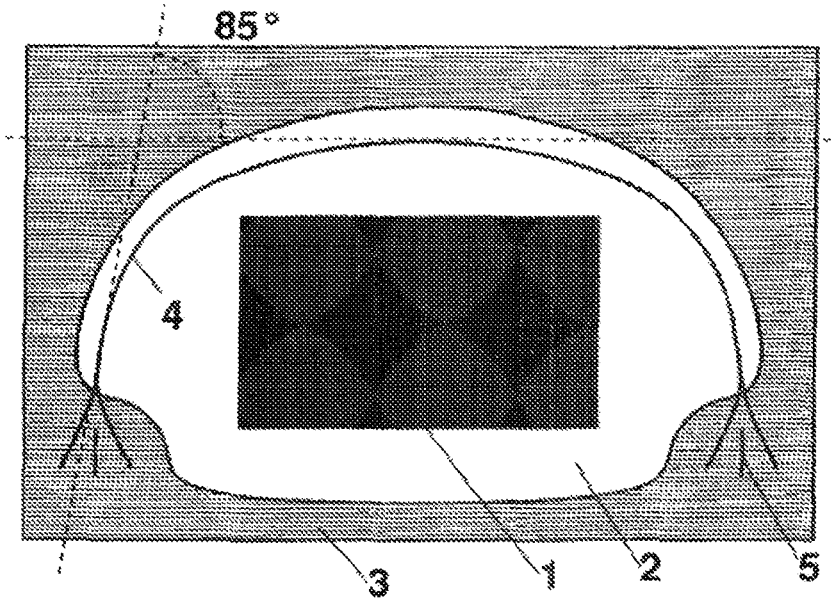
FIGS. 2A and 2B show different tear diversions.
Figure 2B:
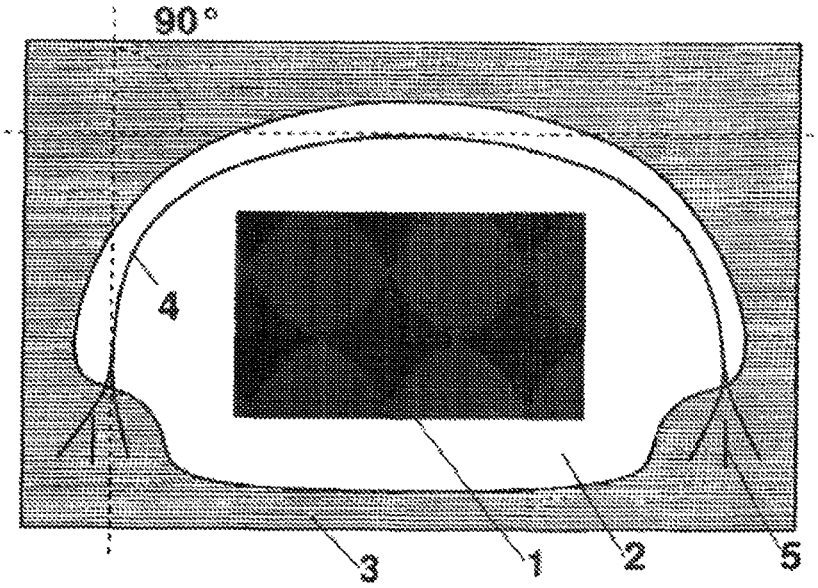

Viewed from the centre of gravity of the single dose, this arc covers an angle range of more than 180°. The arc can have different tear diversions. FIGS. 2A and 2B show two possible tear diversions. The tear diversion in FIG. 2A measures 85°, and the tear diversion in FIG. 2B measures 90°.

An example of a design according to FIG. 2B is a package consisting of a pouch, of which the top is made of a composite of PET measuring 10 to 100 micrometres, preferably 10 to 50 micrometres, aluminium measuring 12 micrometres and Barex measuring 28 to 50 micrometres, and is equipped with the line of weakness by laser treatment, and of which the underside is made of a laminate of PET (0 to 12 micrometres), aluminium (12 micrometres) and Barex (28 micrometres) and is not laser-treated. Although the tear behaviour is in principle similar, it does not follow the curved line quite so exactly, but it is easier to produce since only one side has to be laser-treated. The curved line of weakness should be designed, by suitable selection of radii, such that the tear diversion is reliably by 90°. In the case of pouch dimensions of 45 to 65 mm, for example, a radius of curvature of 20 mm has been determined as being suitable. It can be advantageous that the tear diversion does not have to reach 90° but instead slightly less, e.g. 85° as shown in FIG. 2A. This can be achieved by the fact that the curved line can be made trapezoidal.

Figure 3:
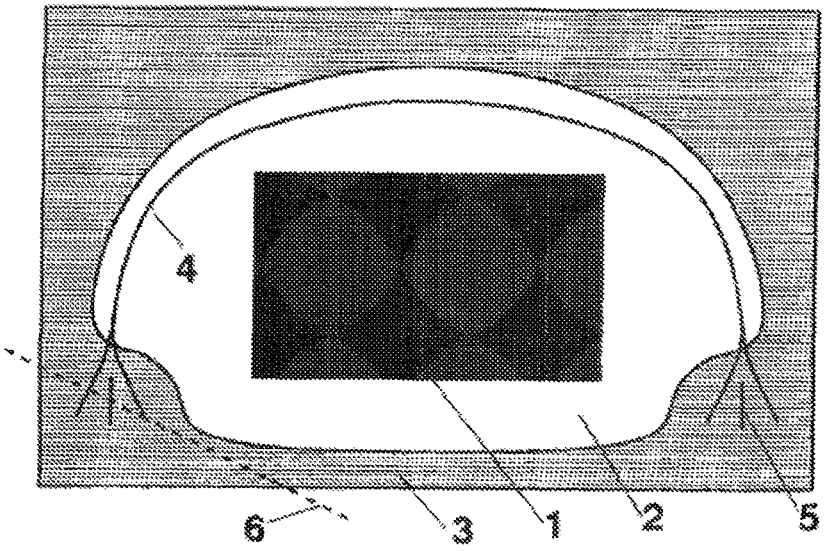
FIG. 3 shows a schematic view of the opening of a preferred package.

In the examples, the start area and the end area of the line of weakness lie in the sealed area. Such a pouch could not be opened manually without the aid of cutting implements, the sealing seam cannot be opened, and, on account of the stability of the outer cover layer, the film itself also cannot be torn. Manual opening is now achieved, as is shown in FIG. 3, by targeted local weakening of the cover layer within the circumference, without touching the circumference of the package. It is only when the package is folded along a fold line (6) that the local weakness (4) is shifted to the edge of the (folded) package and thus allows tearing, e.g. at the sidecut (5).

Figure 4:
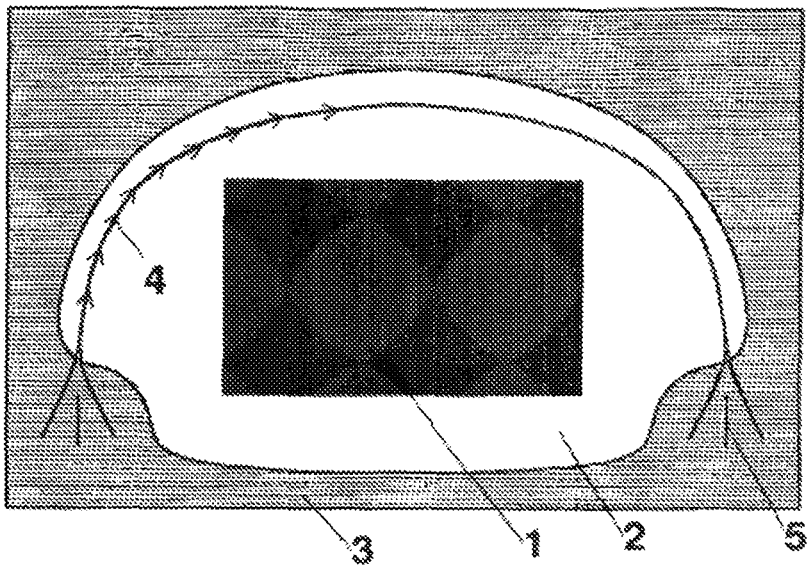
FIG. 4 shows a schematic view of a cover layer, which is provided with marks for indicating the opening.

As is shown in FIG. 4, the cover layer can contain elements, here arrows, which point to the opening mechanism, the weakening or the direction of opening.

Figure 5:
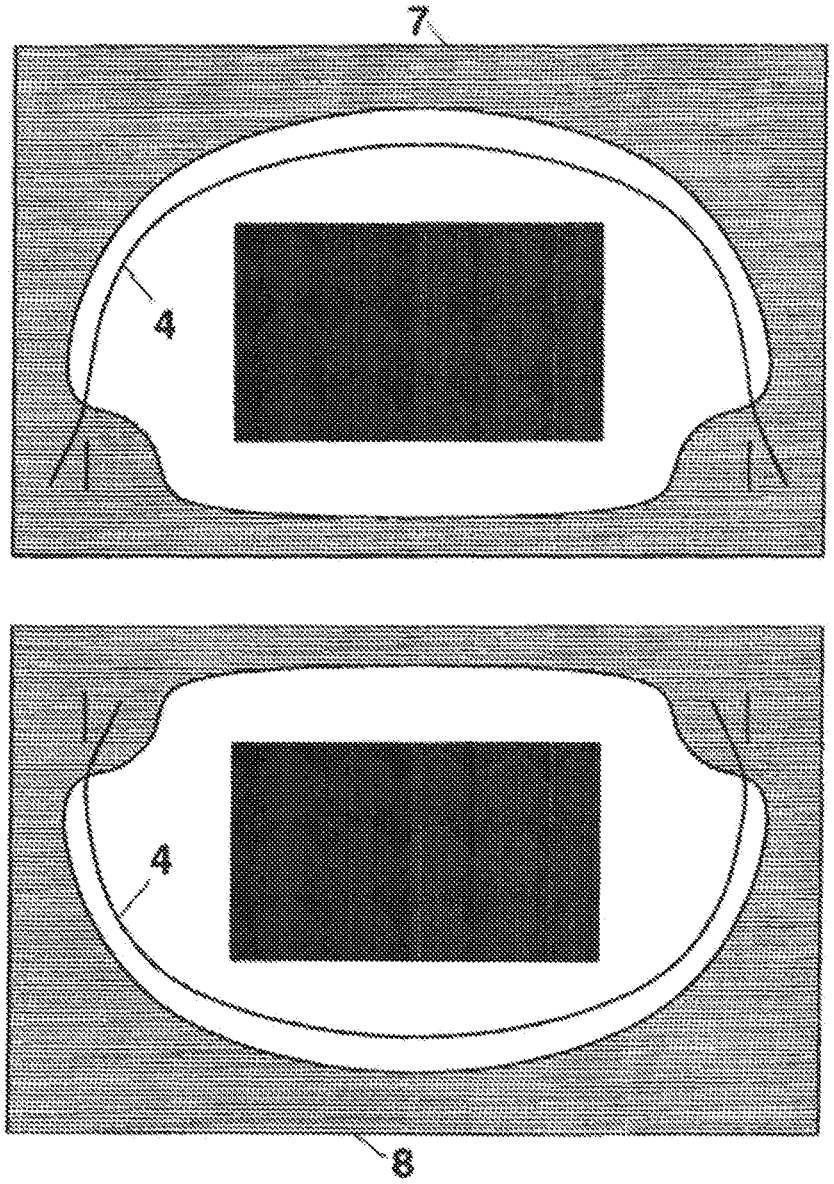
FIG. 5 shows the top and underside of a preferred embodiment.

The local weaknesses can have different forms on the top (7) and underside (8) of the package, as is shown in FIG. 5. For example, the weaknesses (4) can be designed such that the Y-shaped areas at the start and end of the weakness, which serve to catch the tear, are obtained only when the two package halves are superposed. This saves time during production.

What is claimed is:

1. Childproof package including a single dose, in particular for film-shaped administration forms containing active substance, said package comprising a pouch which is produced by sealing, the pouch includes an unsealed area for housing the film-shaped single dose and the package having a top face and an underside face each having a cover layer with a minimum tear resistance of 30 Newtons including on the respective top face and underside face a line of weakness that does not touch an edge of the package, the package includes a sealing seam in surrounding relationship with the unsealed area, each of the lines of weakness form a continuous pattern that extends through the unsealed area in an arc or in a curved path at a predetermined distance from an outer contour of the film-shaped single dose and partially surrounding the film-shaped single dose which lies in a center of the arc or the curved path such that a predetermined portion of each cover layer having the line of weakness remains attached to the sealing seam after opening of the pouch and, viewed from a center of gravity of the film-shaped single dose, covers an angle range of at least 90°, each of the lines of weakness are superposed with respect to one another and each line of weakness includes a start area and an end area operatively positioned in the sealing seam;

the package additionally has, proximate to but separated from at least one of the start area and the end area of each of the lines of weakness, a sidecut, which does not reach as far as an the edge of the package or an edge of the unsealed area of the package prior to opening of the pouch, and the start area and end area of the each of the lines of weakness have a predetermined configuration for forming a tear catcher;

each of the lines of weakness are in the form of a U for exposing three sides of the outer contour of the centered film-shaped single dose in a single-motion during opening of the package while leaving a remaining side of the outer contour of the film-shaped single dose unexposed; and, the superposed tear catchers of the start areas and the end areas of the lines of weakness form a Y configuration only when the respective lines of weakness are superposed, whereby when a tear initiation is effected by the sidecut, a subsequent catching and guiding of the tear along the arc or the curved path is effected by the superposed Y configuration start and end areas of the lines of weakness.

2. The childproof package of claim 1, wherein the Y configuration of the superposed tear catcher of the respective start areas and end areas of the lines of weakness includes the line of weakness on the top face has a first branch of the Y configuration at the respective start area and the respective end area and the line of weakness on the underside face has a second branch of the Y configuration at the respective start area and the respective end area.

* * * * *